US007422508B2

(12) United States Patent
Bentham

(10) Patent No.: US 7,422,508 B2
(45) Date of Patent: Sep. 9, 2008

(54) GARMENTS AND METHODS OF MANUFACTURING

(75) Inventor: Martin Bentham, South Yorkshire (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 384 days.

(21) Appl. No.: 10/836,328

(22) Filed: Apr. 30, 2004

(65) Prior Publication Data

US 2005/0003736 A1 Jan. 6, 2005

Related U.S. Application Data

(60) Provisional application No. 60/466,480, filed on Apr. 30, 2003.

(51) Int. Cl.
*A41C 3/14* (2006.01)
*A42C 5/00* (2006.01)

(52) U.S. Cl. ..... 450/86; 450/1; 450/93; 450/41; 2/255; 2/243.1

(58) Field of Classification Search ..... 450/1, 450/81, 86, 88, 60–74, 41, 42, 45–51, 53; 2/255–260, 260.1, 261, 264, 73, 78.1–78.4; 524/474, 475, 166, 268, 301, 304, 490, 501; 523/333, 334, 223; 521/65, 70, 72
See application file for complete search history.

(56) References Cited

U.S. PATENT DOCUMENTS

| | | | | |
|---|---|---|---|---|
| 4,558,082 | A | 12/1985 | Eckberg | 522/30 |
| 4,697,026 | A | 9/1987 | Lee et al. | 556/418 |
| 4,728,538 | A | 3/1988 | Kaspar et al. | 427/288 |
| 4,742,092 | A | 5/1988 | Inoue | |
| 5,380,260 | A | 1/1995 | Blott | |
| 5,885,910 | A | 3/1999 | Graichen | |
| 6,194,508 | B1 | 2/2001 | Achenbach et al. | |
| 6,332,825 | B1 | 12/2001 | Henricksen | |
| 6,509,094 | B1 * | 1/2003 | Shah et al. | 428/395 |
| 6,827,628 | B2 * | 12/2004 | Kaye et al. | 450/86 |
| 6,857,934 | B2 * | 2/2005 | Chan | 450/41 |
| 2002/0124952 | A1 | 9/2002 | Sallavanti et al. | |
| 2002/0148386 | A1 | 10/2002 | Woosman et al. | |
| 2003/0010251 | A1 | 1/2003 | Woosman et al. | |

(Continued)

FOREIGN PATENT DOCUMENTS

| | | |
|---|---|---|
| EP | 1 117 502 | 4/2000 |

(Continued)

OTHER PUBLICATIONS

LR 3003/30A US, "*Material Safety Data Sheet—Section 1: Product and Company Identification*", Wacker Silicones Corporation, Jul. 27, 2001.

(Continued)

*Primary Examiner*—Gloria Hale
(74) *Attorney, Agent, or Firm*—Womble Carlyle Sandridge & Rice, PLLC

(57) ABSTRACT

Garments having one or more laser-cured polymeric regions, methods of making, and laser-cured polymers are provided. The polymeric regions can have cure levels that differ from one another. Further, the polymeric regions can have a variable cure level within the individual region.

12 Claims, 2 Drawing Sheets

U.S. PATENT DOCUMENTS

| | | | |
|---|---|---|---|
| 2003/0019373 | A1 | 1/2003 | Jordan |
| 2003/0041963 | A1 | 3/2003 | Gong et al. |
| 2003/0059616 | A1 | 3/2003 | Hartley et al. |

FOREIGN PATENT DOCUMENTS

| | | |
|---|---|---|
| FR | 2792173 | 10/2000 |
| FR | 2808970 | 11/2001 |

OTHER PUBLICATIONS

LR 3003/30B US, "*Material Safety Data Sheet—Section 1: Product and Company Identification*", Wacker Silicones Corporation, Jun. 8, 2001.

Austin Weber, "*Welding with Light*", Clearweld—The Clear Advantage, Jan. 2002.

Xennia, "*Welding with Xennia XPS 9000 Certified Inkjet System*", Clearweld Certified.

Engineering News, "Design News—New Laser Welding draws a Bead on Visible Joints", WWW.clearweld.com, Jan. 2002.

* cited by examiner

GARMENTS AND METHODS OF MANUFACTURING

CROSS REFERENCE TO RELATED APPLICATIONS

This application claims the benefit of U.S. Provisional Application Ser. No. 60/466,480, filed on Apr. 30, 2003, the contents of which are incorporated by reference herein.

BACKGROUND OF THE INVENTION

1. Field of the Invention

The present invention is related to garments and methods of manufacturing garments. More particularly, the present invention is related to garments having laser curable polymers and methods of making such garments.

2. Description of Related Art

Polymers, such as polypropylene elastomers and liquid silicone rubbers (LSR's), have found a wide-variety of uses in the garment industry. For example, polymers have been used in the manufacture of hosiery, such as socks and stockings, to aid in maintaining the hosiery in a desired position. In this use, the polymer can increase friction between the garment and the skin of the wearer.

A liquid form of the polymer can be applied to the garment in a desired location and a desired amount, and then converted to an elastomeric (e.g., rubbery) state by vulcanization or curing. For example, LSR can be vulcanized at high temperatures, in the presence of organic-peroxide curing agents.

It has been common to use convection heat to cure the polymer on the garment. However, convection heating can cause undesired effects. Convection heating can add time and expense to the manufacturing process. For example, the use of convection heat to cure LSR's can-take over thirty (30) seconds at a temperature of over 150 degrees Celsius. In addition, convection heating requires that the entire garment be exposed to the heat condition, which can cause deleterious effects in the garment. Further, all areas or regions of the garment are cured to the same degree in such convection curing processes.

There is a continuing desire for lower cost, higher quality garments. Accordingly, there is a continuing desire for garments and methods of forming such garments that avoid one or more of the aforementioned drawbacks of the prior art.

BRIEF SUMMARY OF THE INVENTION

It is an object of the present invention to provide a garment having one or more laser-cured polymeric regions.

It is another object of the present invention to provide a garment having one or more laser-cured polymeric regions, where such regions can have elasticity levels and/or cure levels different from one another.

It is yet another object of the present invention to provide a method of forming garments with laser cured polymers.

It is still another object of the present invention to provide a laser curable polymer mixture.

These and other objects and advantages of the present invention are provided by a garment having a fabric portion and a first polymeric region cured on the fabric portion. The first polymeric region has a dimension and a first cure level that differs along the dimension.

The present invention also provides a garment having a fabric portion, a first polymeric region, and a second polymeric region. The first and second polymeric regions are cured on the fabric. The first polymeric region has a first cure level, while the second polymeric region has a second cure level. The second cure level differs from the first cure level.

The present invention also provides a method of manufacturing a garment. The method includes applying a polymer to a selected area of the garment and emitting laser energy at the polymer to cure the polymer on the selected area to a selected cure level.

A laser curable polymeric mixture is also provided by the present invention. The mixture includes a polymer selected from the group consisting of polypropylene elastomer, liquid silicone rubber, and any combinations thereof and an infrared absorbing agent selected from the group consisting of carbon black, an infrared absorbing ink, an infrared absorbing dye, and any combinations thereof.

Further, the present invention provides a brassiere having a shoulder-engaging region, a body-encircling region, and an underwire region. The shoulder-engaging region has a first polymeric area cured thereon. The first polymeric area has a first polymer quantity and a first cure level for imparting a selected cushioning to the shoulder-engaging region. The second polymeric area has a second polymer quantity and a second cure level for imparting a selected elasticity to the body-encircling region. The third polymeric area has a third polymer quantity and a third cure level for imparting a selected rigidity to the underwire region.

The above-described and other features and advantages of the present invention will be appreciated and understood by those skilled in the art from the following detailed description, drawings, and appended claims.

DETAILED DESCRIPTION OF THE INVENTION

Figure 1:
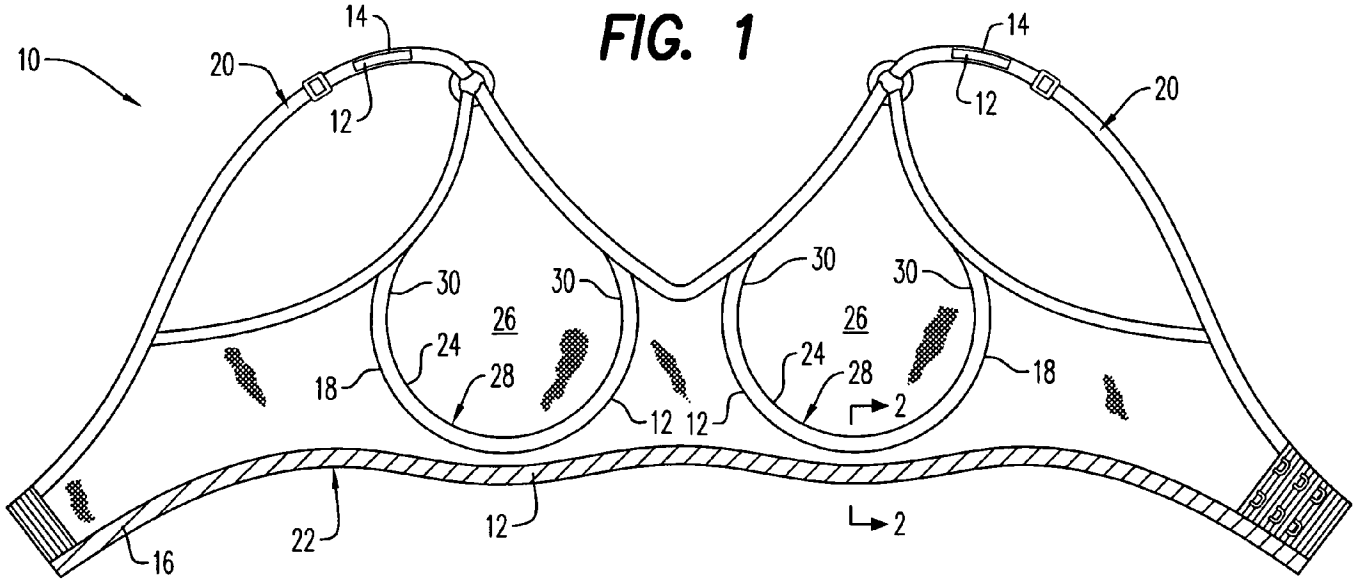
FIG. 1 is a plan view of a garment of the present invention.

Referring to the drawings and in particular to FIG. 1, there is provided a substrate generally referred to by reference numeral 10. For purposes of clarity, substrate 10 is illustrated herein as a garment, particularly a brassiere.

It is contemplated by the present invention for substrate 10 to be a non-garment substrate. In addition, substrate 10 can be a garment other than a brassiere, such as, but not limited to, a pair of pants, a pair of shorts, a skirt, a shirt, a blouse, a sock, a pair of stockings, a pair of underwear, a panty, a bathing suit, a leotard, a medical brace, and other wearing apparel.

Brassiere 10 has a polymer 12. Polymer 12 can be cured on brassiere 10 in a first area 14, a second area 16, a third area 18, or any combinations thereof.

It has been determined that the physical properties of polymer 12 can be varied to provide brassiere 10 with one or more desired characteristics in each of the first, second, and third areas 14, 16, 18, respectively.

The physical properties of polymer 12 can be varied by varying the cure level of the polymer and/or by varying the quantity of the polymer that is applied to each area 14, 16, 18.

The cure level of polymer 12 can affect the durometer of the cured polymer. As used herein, the durometer of polymer 12 is a determinant of the hardness of the polymer. For example, low durometer polymer 12 exhibits softness and elasticity, while high durometer polymer 12 exhibits hardness and rigidity. Thus, polymer 12 can be cured to a first level (e.g., standard cure) to provide softness and elasticity to brassiere 10 in one or more of the first, second, and third areas 14, 16, 18. Alternately, polymer 12 can be cured to a second, higher cure level (e.g., over cure) to provide hardness and rigidity to brassiere 10 in one or more portions of first, second, and third areas 14, 16, 18.

In addition, the quantity of polymer 12 that is applied to each area 14, 16, 18 can affect the resultant physical property the polymer imparts to that area. Namely, as the quantity of polymer 12 applied in areas 14, 16, 18 is increased, the level of elasticity and/or rigidity imparted to that area can also be increased.

Accordingly, the physical properties of polymer 12 can be varied to provide brassiere 10 with one or more desired characteristics in each of the first, second, and third areas 14, 16, 18, respectively.

It has been found that polymer 12 can be provided with the selected cure level using energy emitted from a laser (e.g., light amplification by stimulated emission of radiation). The laser can emit a light beam of a desired wavelength into polymer 12 to heat and, thus, cure the polymer.

Preferably, the emitted light is non-visible and has a wavelength between about 0.81 microns and about 10.6 microns. For example, a laser, such as, but not limited to, a carbon dioxide laser, a diode laser, or a neodynium-yttrium-aluminum-garnet (Nd:YAG) laser, can emit non-visible light in the aforementioned ranges.

The cure level of polymer 12 can be customized by adjusting the wavelength of the laser, the intensity of the laser, time the polymer is exposed to the laser, or any combination of the foregoing.

In the exemplary embodiment of brassiere 10 illustrated in FIG. 1, first area 14 is cured on the brassiere at a shoulder-engaging region 20 of the brassiere. Polymer 12 in first area 14 is preferably applied in a first quantity and cured to the first cure level. Polymer 12 in this first amount and first cure level provides first area 14 with a desired cushioning effect between shoulder-engaging region 20 and the shoulder (not shown) of a wearer. In addition, polymer 12 provides first area 14 with a select level of friction or grippability between shoulder-engaging region 20 and the shoulder.

For example, it has been determined that applying polymer 12 in a first quantity of less than about 0.05 grams per square centimeter is sufficient to provide first area 14 with the aforementioned cushioning and anti-slip physical properties.

Second area 16 is cured on brassiere 10 at a body-encircling region 22 of the brassiere. In second area 16, polymer 12 can be applied in a second quantity and cured to the first cure level. Polymer 12 in this second amount and first cure level provides second area 16 with sufficient elasticity to retain body-encircling region 22 of brassiere 10 against a wearer. Thus, second area 16 can be used in place of, or in addition to, traditional elastic bands.

For example, it has been determined that applying polymer 12 in a second quantity of about 0.05 grams per square centimeter is sufficient to provide a level of elasticity suitable for second area 16. Accordingly, the second quantity of polymer 12 provides a level of elasticity to retain body-encircling region 22 against the wearer in this example.

Third area 18 is cured on brassiere 10 at an underwire region 24 of the brassiere, which preferably defines a periphery of a breast cup 26. In third area 18, polymer 12 can be applied in a third amount and can be cured to a second cure level. Polymer 12 in this third amount and second cure level provides third area 18 with sufficient rigidity to support breast cup 26. In this manner, third region 18 can replace the traditional metal underwire of prior art brassieres, which required metal under wires costly and time consuming sewing processes to secure the under wires to the brassiere.

For example, it has been determined that applying polymer 12 in a third quantity of about 0.1 grams per square centimeter and the second cure level is sufficient to provide sufficient level of rigidity suitable for third area 18.

The use of a laser to cure polymer 12 allows the cure level of polymer 12 within each area 14, 16, 18 to be varied. For example, third area 18 can have a curved shape defining a length 28 with a tip region 30 formed at each end. Advantageously, the cure level of third area 18 can be varied along length 28 to enhance the comfort of brassiere 10. For example, tip region 30 can have a lower durometer (i.e., softer) as compared to other portions of third area 18 along length 28 (i.e., harder). Thus, the cure level of third area 18 can be varied along length 28 to enhance the comfort of the third area.

Figure 2:
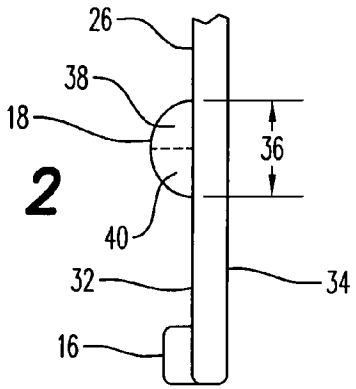
FIG. 2 is a sectional view of the garment of FIG. 1 taken along lines 2-2.

Referring to FIG. 2, a sectional view of brassiere 10 is illustrated. Brassiere 10 has a first or body facing surface 32 and a second or outward facing surface 34. In the illustrated embodiment, third area 18 has a width 36 formed on first surface 32. Width 36 defines an upper portion 38 and a lower portion 40 of third area 18. Upper portion 38 is proximate breast cup 26, while lower portion 40 is remote from the breast cup. In this position, upper portion 38 contacts the wearer's breast (not shown).

Again, the quantity and cure level of polymer 12 within third area 18 can be varied to enhance the comfort of brassiere 10. For example, upper portion 38 can be cured to the first level (i.e., softer and more elastic) as compared to lower portion 40 (i.e., harder and more rigid). Thus, the cure level of third area 18 can be varied along width 36 to enhance the comfort of the third area.

Figure 3:
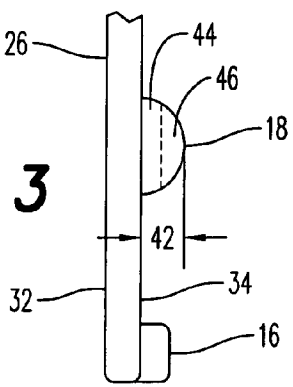
FIG. 3 is an alternate embodiment of the garment of FIG. 2.

Referring now to FIG. 3, an alternate embodiment of the sectional view of FIG. 2 is illustrated. In this embodiment, third area 18 has a thickness 42 formed on second surface 34. Thickness 40 defines an inner portion 44 and an outer portion 46 of third area 18. Inner portion 44 is proximate breast cup 26, while outer portion 46 is remote from the breast cup. In this position, inner portion 44 interfaces with the wearer's breast (not shown) through the fabric of brassiere 10.

In this embodiment, inner portion 44 can be selectively cured to the first cure level (i.e., softer) as compared to outer portion 46 (i.e., harder) to enhance the comfort of the wearer. Thus, the cure level of third area 18 can be varied along thickness 42 to enhance the comfort of the rigid third area.

Accordingly, third area 18 can have a number or plurality of varying cure levels disposed along its length 28, width 36, and/or thickness 42 to provide brassiere 10 with enhanced comfort and support capabilities.

It should be recognized that second and third areas 16, 18 are illustrated in FIGS. 2 and 3 by way of example as either both on first surface 32 or both on second surface 34. However, it is contemplated by the present invention for any of the first, second, and/or third areas 14, 16, 18 to be formed on any combination of the first and second surfaces 32, 34.

It should also be recognized that third area 18 is described herein by way of example as being cured to the second (e.g., over cured) level. Of course, it is contemplated by the present invention for polymer 12 in third area to be cured to the first level (e.g., standard cure) to provide underwire region 24 with a selected level of elasticity.

Polymer 12 can be the same polymer in first, second, and third areas 14, 16, 18. Alternately, different polymers 12 can used in first, second, and third areas 14, 16, 18. Polymer 12 can be, for example, a liquid silicone rubber. For example, polymer 12 can be LR 3003/30A and/or LR 3003/30B that are commercially available from Wacker Silicone Corporation.

Figure 4:
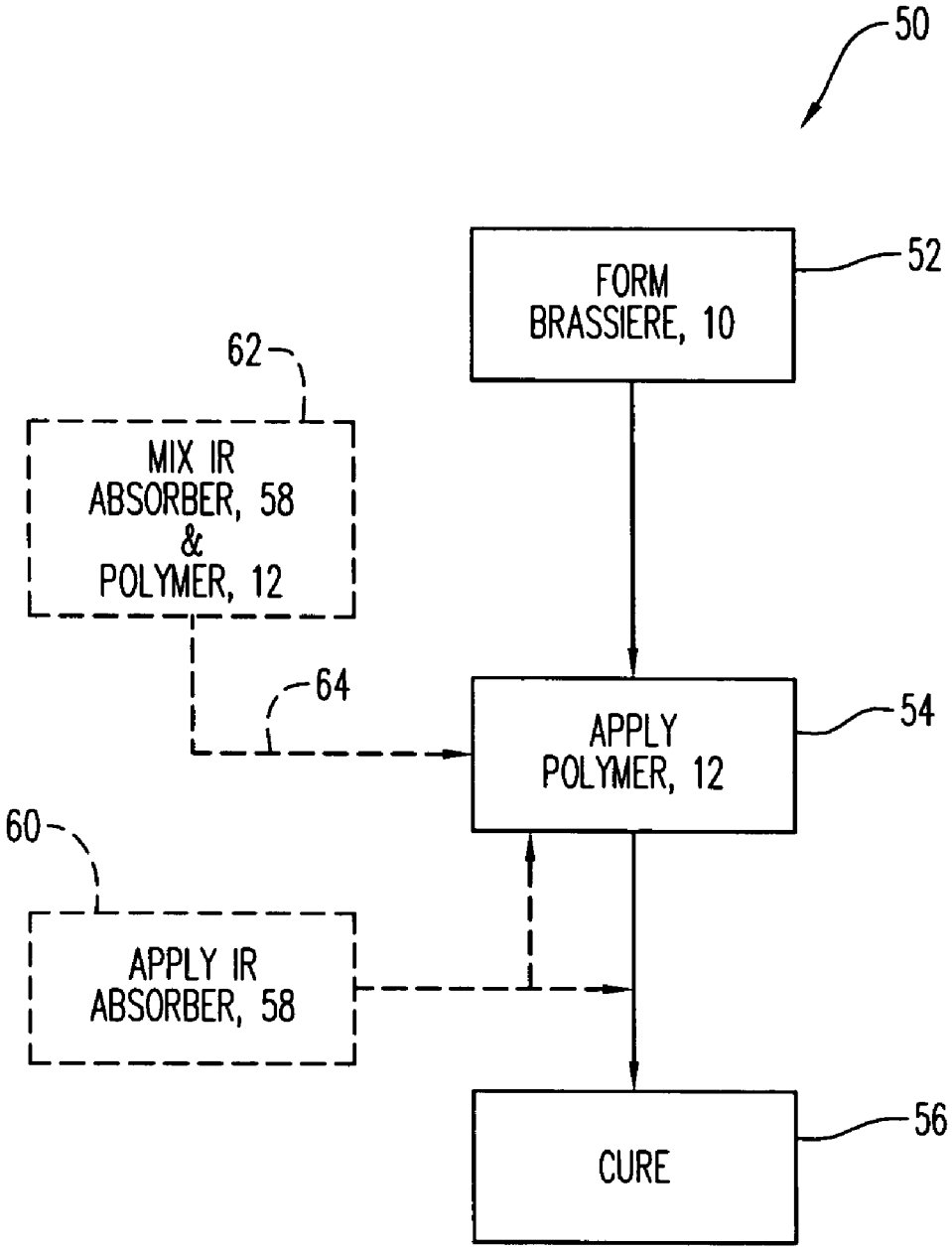
FIG. 4 is a block diagram of an exemplary embodiment of a garment manufacturing method according to the present invention.

Referring now to FIG. 4, an exemplary embodiment of a garment manufacturing method 50 is illustrated. Method 50 includes a substrate forming process 52, a polymer application process 54, and a curing process 56.

Substrate forming process 52 can form any desired substrate. In the example described herein where the substrate is illustrated as a garment, forming process 52 can be any garment manufacturing process, such as, but not limited to, a traditional cut-and-sew process, a circular knitting process, a lamination process, any other garment forming process, or any combinations of the foregoing.

After the desired substrate is formed in process 52, polymer 12 is applied to the substrate in application process 54. Application process 54 can be any process suitable to apply polymer 12 in the desired locations, amounts, and shapes. For example, application process 54 can include spraying, screen-printing, wipe-on or brush-on processes, other application process, or any combination of the foregoing.

After or substantially simultaneous to the application of polymer 12 by application process 54, the polymer is cured by curing process 56. Curing process 56 exposes polymer 12 to laser energy to cure the polymer to the desired level. The curing process 56 can include moving the laser energy source with respect to polymer 12, moving the polymer with respect to the laser energy source, and/or combinations of the foregoing.

Curing process 56 exposes polymer 12 to laser energy of desired power and wavelength for a desired time. For example, curing process 56 can expose polymer 12 to energy emitted by a carbon dioxide laser having a wavelength of about 10.6 microns and a power level of up to about 1000 watts. In this example, polymer 12 in the first, second, and third areas 14, 16, 18 can be cured at a speed of about 25 meters per minute.

Alternate exemplary embodiments of method 50 are illustrated in phantom in FIG. 4. It has been found that the absorption of laser energy by polymer 12 can be increased by including an infrared absorbing agent 58 in laser curing process 50. By increasing the absorption of laser energy by polymer 12, the power of the laser can be reduced, the exposure time can be reduced, the wavelength can be modified, the cure level can be modified, or any combination of the foregoing.

Infrared absorbing agent 58 can include any agent capable of absorbing infrared energy at least at the emitted wavelength. Thus, absorbing agent 58 can be, for example, a universal infrared absorber, such as, carbon black. Alternately, infrared absorbing agent 58 can absorb infrared energy only at the emitted wavelength. For example, infrared absorbing agent 58 can be an absorbing ink or dye. Preferably, infrared absorbing agent 58 is an absorbing ink or dye commercially available from Gentex Corporation and described in published U.S. patent application Ser. Nos. 2002/0124952 A1, 2002/0148386 A1, or 2003/0010251, the contents of which are incorporated herein by reference in their entirety.

In a first embodiment, infrared absorbing agent 58 can be applied in an absorbing agent application process 60. Agent application process 60 applies infrared absorbing agent 58 prior to curing process 56.

For example, infrared absorbing agent 58 can be applied to polymer 12 subsequent to and/or simultaneous to polymer application process 54. Agent application process 60 can print or spray infrared absorbing agent 58 onto polymer 12 that is resident on brassiere 10.

In a second, preferred embodiment, method 50 includes a mixing step 62. Mixing step 62 dissolves or disperses (hereinafter "mixes") infrared absorbing agent 58 in polymer 12 to form a mixture 64. Next, mixture 64 is applied to brassiere 10 by application process 54.

Mixture 64 includes an amount of infrared absorbing agent 58 sufficient to provide the desired energy absorption. In a preferred embodiment, mixture 64 has a selected amount of LR 3003/30A, a selected amount of LR 3003/30B, and a selected amount of absorbing ink, which is commercially available from Gentex Corporation.

First, second, and third areas 14, 16, 18 are described above by way of example as being located in shoulder-engaging region 20, body-encircling region 22, and underwire region 24, respectively. Of course, it is contemplated by the present invention for brassiere 10 to have polymer 12 at regions other than and/or in addition to regions 20, 22, 24.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention.

What is claimed is:

1. A brassiere comprising:

a shoulder-engaging region having a first polymeric area cured thereon, said first polymeric area having a first polymer quantity and a first cure level for imparting a selected cushioning to said shoulder-engaging region;

a body-encircling region having a second polymeric area cured thereon, said second polymeric area having a second polymer quantity and a second cure level for imparting a selected elasticity to said body-encircling region; and an underwire region having a third polymeric area cured thereon, said third polymeric area having a third polymer quantity and a third cure level for imparting a selected rigidity to said underwire region.

2. The brassiere as in claim 1, wherein said first polymeric area provides a selected level of friction or grippability to said shoulder-engaging region.

3. The brassiere as in claim 1, wherein said first polymer quantity and/or said second polymer quantity comprises less than about 0.05 grams per square centimeter.

4. The brassiere as in claim 1, wherein said third polymer quantity comprises about 0.1 grams per square centimeter.

5. The brassiere as in claim 1, wherein said first cure level differs from said second cure level and/or said third cure level.

6. The brassiere as in claim 1, wherein said first, second, and third polymeric areas comprise cured liquid silicone rubber.

7. A brassiere comprising:

a first polymeric region cured on a shoulder-engaging region, said first polymeric region having a first cure level; and a second polymeric region cured on a body-encircling region, said second polymeric region having a second cure level, said second cure level differing from said first cure level.

8. The brassiere as in claim 7, further comprising a third polymeric region cured on an underwire region, said third polymeric region having a third cure level, said third cure level differing from said first cure level and/or said second cure level.

9. The brassiere as in claim 7, wherein said first polymeric region provides a selected level of friction or grippability to said shoulder-engaging region.

10. The brassiere as in claim 7, wherein said first and second polymeric regions comprise cured liquid silicone rubber and/or cured polypropylene elastomer.

11. A brassiere comprising:

a first polymeric region cured on a shoulder-engaging region, said first polymeric region having a first cure level; and a second polymeric region cured on a body-encircling region, said second polymeric region having a second cure level, said second cure level differing from said first cure level, said first and second polymeric regions comprising cured liquid silicone rubber and/or cured polypropylene elastomer, wherein said cured liquid silicone rubber and/or said cured polypropylene elastomer further comprise an infrared absorbing agent.

12. The brassiere as in claim 11, wherein said infrared absorbing agent is selected from the group consisting of carbon black, an infrared absorbing ink, an infrared absorbing dye, and any combinations thereof.

* * * * *